US007438741B1

(12) United States Patent
Bangaru et al.

(10) Patent No.: US 7,438,741 B1
(45) Date of Patent: Oct. 21, 2008

(54) EROSION-CORROSION RESISTANT CARBIDE CERMETS FOR LONG TERM HIGH TEMPERATURE SERVICE

(75) Inventors: Narasimha-Rao Venkata Bangaru, Annandale, NJ (US); ChangMin Chun, Belle Mead, NJ (US); Neeraj Srinivas Thirumalai, Phillipsburg, NJ (US); Shiun Ling, Washington, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/829,823

(22) Filed: Apr. 22, 2004

Related U.S. Application Data

(60) Provisional application No. 60/471,789, filed on May 20, 2003.

(51) Int. Cl.
*C22C 29/06* (2006.01)

(52) U.S. Cl. ..... 75/240

(58) Field of Classification Search ..... 75/252, 75/240

See application file for complete search history.

(56) References Cited

U.S. PATENT DOCUMENTS

| | | | | | |
|---|---|---|---|---|---|
| 2,753,621 | A | * | 7/1956 | Wellborn | 75/240 |
| 3,552,937 | A | * | 1/1971 | Satoru et al. | 75/240 |
| 3,556,747 | A | * | 1/1971 | Hyde et al. | 428/564 |
| 3,971,633 | A | * | 7/1976 | Wolfla et al. | 428/552 |
| 4,173,457 | A | | 11/1979 | Smith | 51/309 |
| 4,275,090 | A | * | 6/1981 | McComas et al. | 427/451 |
| 4,401,724 | A | | 8/1983 | Moskowitz et al. | 428/564 |
| 4,426,423 | A | | 1/1984 | Intrater et al. | 428/408 |
| 4,475,983 | A | | 10/1984 | Bader et al. | 156/656 |
| 4,505,746 | A | | 3/1985 | Nakai et al. | 75/243 |
| 4,515,866 | A | | 5/1985 | Okamoto et al. | 428/614 |
| 4,535,029 | A | | 8/1985 | Intrater et al. | 428/408 |
| 4,610,810 | A | | 9/1986 | Hasegawa et al. | 252/511 |
| 4,615,913 | A | | 10/1986 | Jones et al. | 427/226 |
| 4,626,464 | A | | 12/1986 | Jachowski et al. | 428/212 |
| 4,643,951 | A | | 2/1987 | Keem et al. | 428/469 |
| 4,682,987 | A | | 7/1987 | Brady et al. | 51/293 |
| 4,696,764 | A | | 9/1987 | Yamazaki | 252/503 |
| 4,707,384 | A | | 11/1987 | Schachner et al. | 427/249 |
| 4,711,660 | A | | 12/1987 | Kemp, Jr. et al. | 75/0.5 B |
| 4,721,878 | A | | 1/1988 | Hagiwara et al. | 313/362.1 |
| 4,725,508 | A | | 2/1988 | Rangaswamy et al. | 428/570 |
| 4,734,339 | A | | 3/1988 | Schachner et al. | 428/701 |
| 4,806,161 | A | | 2/1989 | Fabiny et al. | 106/14.12 |
| 4,808,055 | A | | 2/1989 | Wertz et al. | 416/224 |
| 4,886,638 | A | * | 12/1989 | Penkunas et al. | 419/15 |
| 5,057,340 | A | * | 10/1991 | Iyer et al. | 427/367 |
| 5,098,748 | A | * | 3/1992 | Shimizu et al. | 427/451 |
| 5,863,618 | A | * | 1/1999 | Jarosinski et al. | 427/450 |
| 5,906,896 | A | * | 5/1999 | Jackson et al. | 428/621 |
| 5,944,644 | A | * | 8/1999 | Katayama et al. | 492/54 |
| 6,482,534 | B2 | * | 11/2002 | Itsukaichi et al. | 428/569 |
| 6,537,343 | B2 | * | 3/2003 | Majagi et al. | 75/240 |
| 6,562,480 | B1 | * | 5/2003 | Stong et al. | 428/546 |
| 2002/0189722 | A1 | * | 12/2002 | Hasz et al. | 148/528 |
| 2003/0070464 | A1 | * | 4/2003 | Morales | 72/60 |

FOREIGN PATENT DOCUMENTS

| | | | | |
|---|---|---|---|---|
| EP | 0482831 | A1 | | 10/1991 |
| EP | 0641869 | A1 | | 9/1994 |
| JP | 54-108150 | | * | 8/1979 |
| JP | 1998195585 | A | | 7/1998 |
| JP | 2000345314 | | | 12/2000 |
| WO | WO 8301917 | | | 6/1983 |

* cited by examiner

*Primary Examiner*—Roy King
*Assistant Examiner*—Ngoclan T Mai
(74) *Attorney, Agent, or Firm*—Robert A. Migliorini; Ramesh Varadaraj

(57) ABSTRACT

Cermets are provided in which the ceramic phase is selected from the group consisting of $Cr_{23}C_6$, $Cr_7C_3$, $Cr_3C_2$ and mixtures thereof. The binder phase is selected from certain specified Ni/Cr alloys and certain Fe/Ni/Cr alloys. These cermets are particularly useful in protecting surfaces from erosion at high temperatures.

6 Claims, 4 Drawing Sheets

EROSION-CORROSION RESISTANT CARBIDE CERMETS FOR LONG TERM HIGH TEMPERATURE SERVICE

This application claims the benefit of U.S. Provisional application 60/471,789 filed May 20, 2003.

FIELD OF INVENTION

The present invention relates to cermet compositions. More particularly the invention relates to chromium carbide containing cermet compositions and their use in high temperature erosion and corrosion applications.

BACKGROUND OF INVENTION

Abrasive and chemically resistant materials find use in many applications where metal surfaces are subjected to substances which would otherwise promote erosion or corrosion of the metal surfaces.

Reactor vessels and transfer lines used in various chemical and petroleum processes are examples of equipment having metal surfaces that often are provided with materials to protect the surfaces against material degradation. Because these vessels and transfer lines are typically used at high temperatures protecting them against degradation is a technological challenge. Currently refractory liners are used to protect metal surfaces exposed at high temperature to erosive or corrosive environments. The lifespan of these refractory liners, however, is significantly limited by mechanical attrition of the liner, especially when exposed to high velocity particulates, often encountered in petroleum and petrochemical processing. Refractory liners also commonly exhibit cracking and spallation. Thus, there is a need for liner material that is more resistant to erosion and corrosion at high temperatures.

Ceramic metal composites or cermets are known to possess the attributes of the hardness of ceramics and the fracture toughness of metal but only when used at relatively moderate temperatures, for example, from 25° C. to no more than about 300° C. Tungsten carbide (WC) based cermets, for example, have both hardness and fracture toughness making them useful in high wear applications such as in cutting tools and drill bits cooled with fluids. WC based cermets, however, degrade at sustained high temperatures, greater than about 600° F. (315° C.).

Chromium carbide has been a potentially suitable ceramic phase for use in cermets because its three crystallographic forms: the cubic ($Cr_{23}C_6$) the hexagonal ($Cr_7C_3$) and the orthorhombic ($Cr_3C_2$) have excellent oxidation resistance at elevated temperatures; yet cermets formed from these carbides typically undergo transformations at elevated temperatures which result in the formation of microstructural phases which have a deleterious effect on the properties of such cermets.

The object of the present invention is to provide new and improved cermet compositions.

Another object of the invention is to provide chromium carbide containing cermet compositions suitable for use at high temperatures.

Another object of the invention is to provide chromium carbide containing cermet compositions with long term microstructural stability suitable for long term service at high temperatures.

Yet another object of the invention is to provide an improved method for protecting metal surfaces against erosion and corrosion under high temperature conditions.

These and other objects will become apparent from the detailed description which follows.

SUMMARY OF INVENTION

Broadly stated, the present invention is a cermet composition comprising a chromium carbide ceramic phase dispersed in a binder phase. The ceramic phase which constitutes about 50 vol % to about 95 vol % of the total volume of the cermet composition is a chromium carbide selected from the group consisting of $Cr_{23}C_6$, $Cr_7C_3$, $Cr_3C_2$ and mixtures thereof.

The binder phase is selected from the group consisting of (i) alloys containing about 60 wt % to about 98 wt % Ni; about 2 wt % to about 35 wt % Cr; and up to 5 wt % of an element selected from the group consisting of Al, Si, Mn, Ti and mixtures thereof; and (ii) alloys containing about 0.01 wt % to about 35 wt % Fe; about 25 wt % to about 97.99 wt % Ni, about 2 wt % to about 35 wt % Cr; and up to about 5 wt % of an element selected from the group consisting of Al, Si, Mn, Ti and mixtures thereof, the wt % in each instance based on the total weight of the alloy.

This and other embodiments of the invention, including where applicable those preferred, will be elucidated in the detailed description which follows.

DETAILED DESCRIPTION OF THE INVENTION

Figure 1:
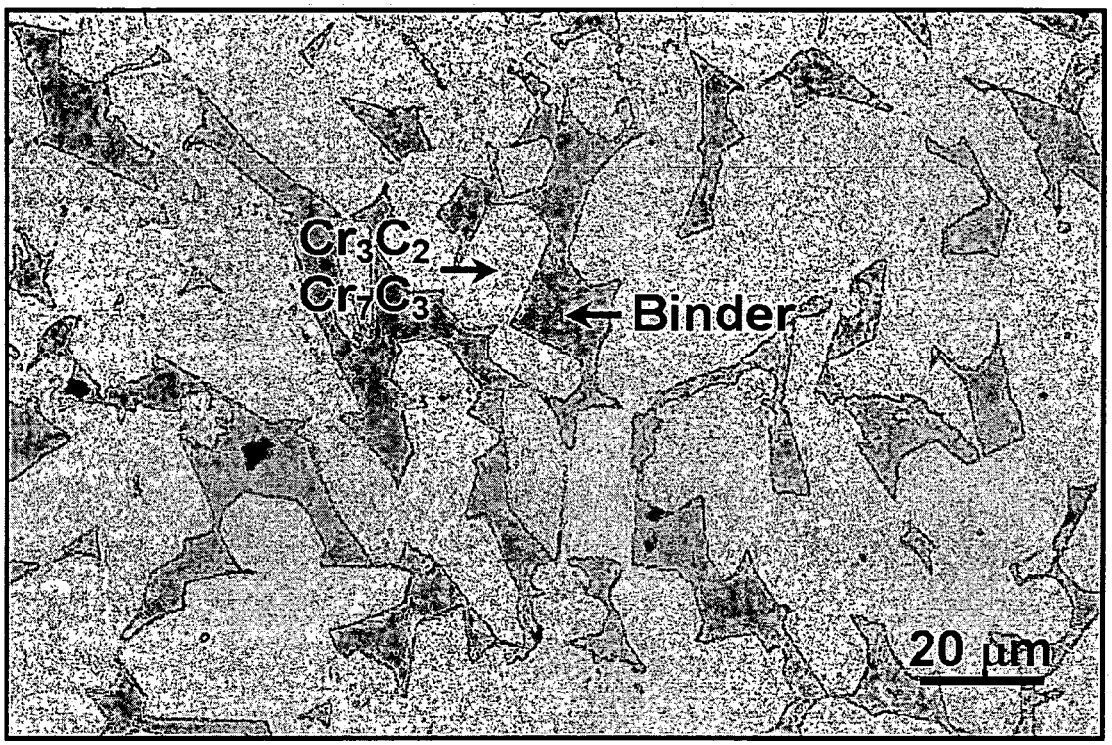
FIG. 1 is a scanning electron microscopy (SEM) image of the surface of a cermet made with an initial $Cr_3C_2$ in 30 vol % Ni-20 Cr binder. Ni-20 Cr indicates 80 wt % Ni and 20 wt % Cr.

In one embodiment the invention is a cermet composition comprising a chromium carbide ceramic phase dispersed in a continuous binder phase.

The ceramic phase constitutes about 50 vol % to about 95 vol % of the total volume of the cermet composition, the ceramic phase being a chromium carbide selected from the group consisting of $Cr_{23}C_6$, $Cr_7C_3$, $Cr_3C_2$, where this group is intended to include sub and super stoichiometric variances thereof.

The particle size diameter of the ceramic phase typically is below about 3 mm, preferably below about 100 μm and more preferably below about 50 μm. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes.

The binder phase is selected from the group consisting of (i) alloys containing about 60 wt % to about 98 wt % Ni; about 2 wt % to about 35 wt % Cr; and up to about 5 wt % of an element selected from the group consisting of Al, Si, Mn, Ti and mixtures thereof; and (ii) alloys containing about 0.01 wt % to about 35 wt % Fe; about 25 wt % to about 97.99 wt %

Ni, about 2 wt % to about 35 wt % Cr; and up to about 5 wt % of an element selected from the group consisting of Al, Si, Mn, Ti and mixtures thereof, the wt % in each instance based on the total weight of the alloy.

Illustration of cermet compositions suitable for use at elevated temperatures include:

(1) about 50 vol % $Cr_7C_3$ in a binder comprising 78 wt % Ni, about 4 wt % Fe and 18 wt % Cr;

(2) about 70 vol % $Cr_7C_3$ in a binder comprising 78 wt % Ni, about 4 wt % Fe and 18 wt % Cr;

(3) about 94 vol % $Cr_7C_3$ in a binder comprising 75 wt % Ni, about 7 wt % Fe, and about 18 wt % Cr;

(4) about 50 vol % $Cr_{23}C_6$ in a binder comprising 72 wt % Ni, about 10 wt % Fe, and 18 wt % Cr;

(5) about 50 vol % $Cr_{23}C_6$ in a binder comprising 67 wt % Ni, 15 wt % Fe and 18 wt % Cr; and (6) about 90 vol % $Cr_{23}C_6$ in a binder comprising 77 wt % Ni, 5 wt % Fe and 18 wt % Cr.

Preferred cermet compositions are the follows:

(1) 50 vol % to 90 vol % $Cr_{23}C_6$ in binder (i);

(2) 50 vol % to 90 vol % $Cr_7C_3$ in binder (i);

(3) 65 vol % to 95 vol % of a mixture of $Cr_3C_2$ and $Cr_7C_3$ where the latter is about 1 vol % to about 18 vol % of the mixture and binder (i).

(4) 50 vol % to 95 vol % of $Cr_3C_2$ in binder (i).

The cermet compositions are made by general powder metallurgical techniques such as mixing, milling, pressing, sintering and cooling, employing as starting materials a chromium carbide ceramic powder and a binder powder in the volume ratio of 50:50 to 95:5 respectively. Preferably the chromium carbide powder is one of $Cr_{23}C_6$, $Cr_7C_3$ and $Cr_3C_2$ although mixtures of these may be used. Preferably the binder is one of the alloy compositions set forth in Table 1.

TABLE 1

| Alloy Type | Composition (wt %) |
|---|---|
| NiCr | Bal Ni: 20 Cr |
| NiCrSi | Bal Ni: 20.1 Cr: 2.0 Si: 0.4 Mn: 0.09 Fe |
| FeNiCr | Bal Fe: > 12 Cr > 36 Ni |

Bal = Balance

These powders are milled in a ball mill in the presence of a sufficient amount of an organic liquid such as ethanol for a time sufficient to substantially disperse the powders in each other. The liquid is removed and the milled powder is dried, placed in a die and pressed into a green body. The green body is then sintered at temperatures above about 1200° C. up to about 1600° C. for times ranging from about 10 minutes to about 4 hours. The sintering operation is preferably performed in an inert atmosphere or a reducing atmosphere or under vacuum. For instance, the inert atmosphere can be argon and the reducing atmosphere can be hydrogen. Thereafter the sintered body is allowed to cool, typically to ambient conditions. The cermet production according to the process described herein allows fabrication of bulk cermet bodies exceeding 5 mm in thickness.

These processing conditions result in the dispersion of the carbide or carbides in the binder. Additionally, the processing results in some compositional changes in the ceramic and binder. For example when the carbide ceramic employed is $Cr_3C_2$ and the binder is a Ni-20Cr alloy, the resultant cermet contained both $Cr_3C_2$ and $Cr_7C_3$ phases with some depletion of Cr in the binder phase. On the other hand, when the ceramic employed is $Cr_{23}C_6$ in the same binder there is substantially no change in the composition of the ceramic.

The volume percent of cermet phase (and cermet components) excludes pore volume due to porosity. The cermet can be characterized by a porosity in the range of 0.1 to 15 vol %. Preferably, the volume of porosity is 0.1 to less than 10% of the volume of the cermet. The pores comprising the porosity is preferably not connected but distributed in the cermet body as discrete pores. The mean pore size is preferably the same or less than the mean particle size of the chromium carbide ceramic phase.

One feature of the cermets of the invention is their long term microstructural stability, even at elevated temperatures, making them particularly suitable for use in protecting metal surfaces against erosion at temperatures in the range of about 300° C. to about 1000° C. This stability permits their use for prolonged time periods, for example greater than 2 years. In contrast many known cermets undergo transformations at elevated temperatures which result in the formation of phases which have a deleterious effect on the properties of the cermet.

The long term microstructural stability of the cermets of the instant invention was confirmed by computational thermodynamics using calculation of phase diagram (CALPHAD) methods known to one of ordinary skill in the art of computational thermodynamic calculation methods. These calculations confirmed that the various carbide phases, their amounts, the binder amount and the respective chemistries lead to cermet compositions with long term microstructural stability. Further, lab experiments were conducted in which the cermet compositions of the instant invention were exposed at 800° C. for 1000 hours in air. Analysis of the bulk microstructure of the resultant cermet after this 1000 h high temperature exposure showed that the starting microstructure was substantially preserved as determined by SEM.

The cermet compositions of the instant invention can exhibit long term microstructural stability lasting at least 25 years when exposed to temperatures up to 1000° C.

Another feature of the cermets of this invention is that they have fracture toughness of greater than about 3 $MPa \cdot m^{1/2}$, preferably greater than about 5 $MPa \cdot m^{1/2}$, and most preferably greater than about 10 $MPa \cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. The binder phase of the cermet of the instant invention as described in the earlier paragraphs is primarily responsible for imparting this attribute.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, side valve gates and guides catalyst regenerators, and the like. Thus, metal surfaces exposed to erosive or corrosive environments, especially at about 300° C. to about 1000° C. are protected by providing the surface with a layer of the ceramic compositions of the invention. The cermets of the instant invention can be affixed to metal surfaces by mechanical means or by welding.

EXAMPLES

Determination of Volume Percent

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analyses.

The following non-limiting examples are included to further illustrate the invention.

Example 1

70 vol % of 14.0 μm average diameter of $Cr_3C_2$ powder (99.5% purity, from Alfa Aesar) and 30 vol % of Ni-20Cr alloy binder powder (Alfa Aesar, screened below 325 mesh) were dispersed with ethanol in high density polyethylene milling jar. The powders in ethanol were mixed for 24 hours with yttria toughened zirconia balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held for 30 min for residual solvent removal. The disc was then heated to 1450° C. at 15° C./min in argon and held at 1450° C. for 1 hour. The temperature was then reduced to below 100° C. at −15° C./min.

The resulting cermet comprises:

i) 63 vol % $Cr_3C_2$ with average grain size of 20 μm ii) 12 vol % $Cr_7C_3$ with average grain size of 20 μm iii) 25 vol % Cr-depleted alloy binder (87Ni:13Cr in wt %).

FIG. 1 is a SEM image of the cermet processed according to this example, wherein the bar represents 20 μm. In this image the chromium carbide phase appears light and the binder phase appears dark.

Example 2

The mixing and pressing procedures of Example 1 was followed using 70 vol % of 14.0 μm average diameter of $Cr_7C_3$ powder (99.5% purity, from Alfa Aesar) and 30 vol % of Ni-20Cr alloy binder powder (Alfa Aesar, screened below 325 mesh). The disc was then heated to 1400° C. for 1 hour at 15° C./min in hydrogen. The temperature was then reduced to below 100° C. at −15° C./min.

The resulting cermet comprised:

i) 67 vol % $Cr_7C_3$ with average grain size of 20 μm ii) 33 vol % Cr-enriched alloy binder (76Ni:24Cr in wt %).

Figure 2:
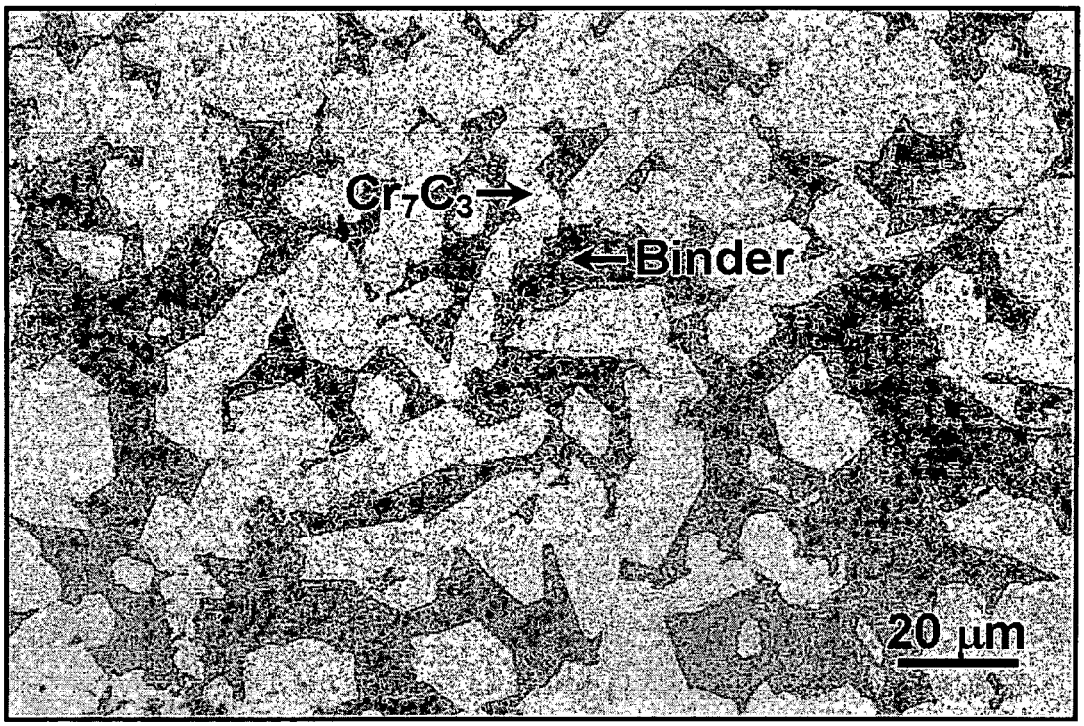
FIG. 2 is a SEM image of the surface of a cermet made with an initial $Cr_7C_3$ in 30 vol % Ni-20 Cr binder.

FIG. 2 is a SEM image of the cermet processed according to this example, wherein the bar represents 20 μm. In this image the chromium carbide phase appears light and the binder phase appears dark.

Example 3

The procedure of Example 2 was followed using 70 vol % of 14.0 μm average diameter of $Cr_{23}C_6$ powder (99.5% purity, from Alfa Aesar) and 30 vol % of Ni-20Cr alloy binder powder (Alfa Aesar, screened below 325 mesh).

The result cermet comprised of:

i) 67 vol % $Cr_{23}C_6$ with average grain size of 20 μm ii) 33 vol % Cr-enriched alloy binder (69Ni:31Cr in wt %).

Figure 3:
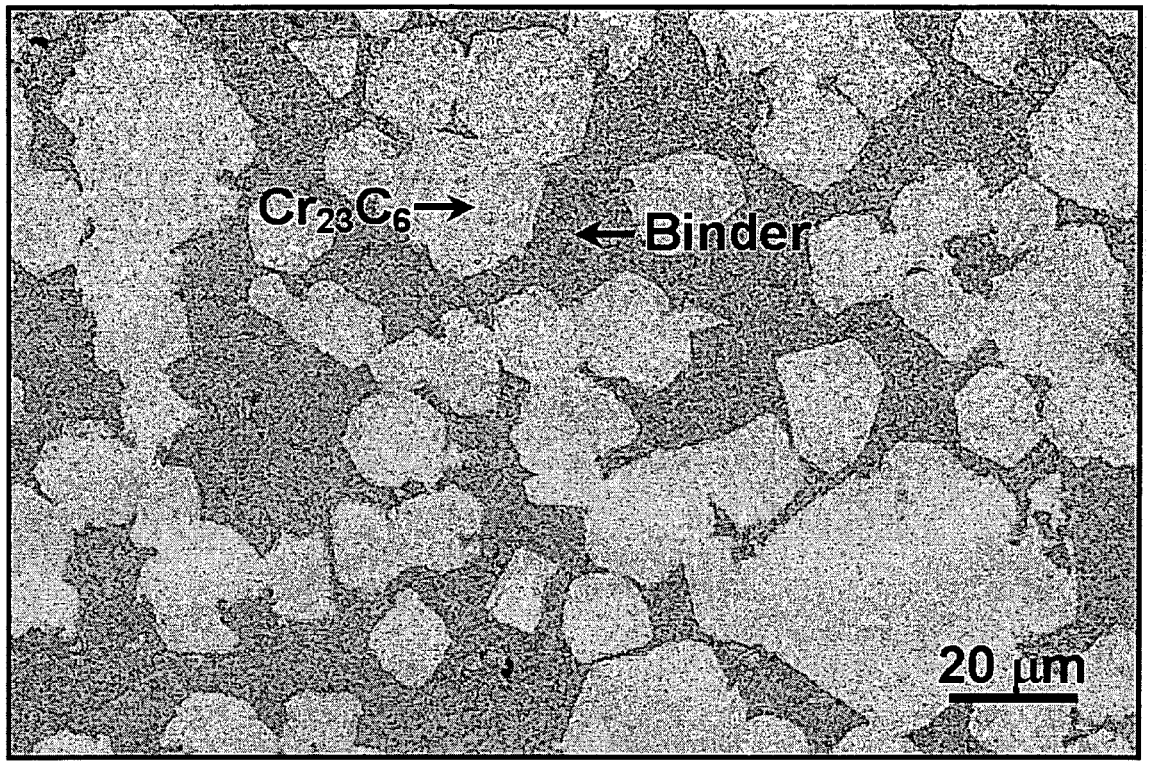
FIG. 3 is a SEM image of the surface of a cermet made with an initial $Cr_{23}C_6$ in a 30 vol % Ni-20 Cr binder.

FIG. 3 is a SEM image of the cermet processed according to this example, wherein the bar represents 20 μm. In this image the chromium carbide phase appears light and the binder phase appears dark.

Example 4

The procedure of Example 2 was followed using 85 vol % of 14.0 μm average diameter of $Cr_3C_2$ powder (99.5% purity, from Alfa Aesar) and 15 vol % of Ni-20Cr alloy binder powder (Alfa Aesar, screened below 325 mesh).

During heating, some $Cr_3C_2$ phase is replaced by $Cr_7C_3$ phase. As result, carbide volume fraction increases and Cr content is depleted in the binder. The result cermet comprised of:

i) 80 vol % $Cr_3C_2$ with average grain size of 20 μm ii) 7 vol % $Cr_7C_3$ with average grain size of 20 μm iii) 13 vol % Cr-depleted alloy binder (85Ni:15Cr in wt %).

Example 5

The cermet compositions of examples 1, 2 and 3 were exposed in air at 800° C. for 1000 hours in a Lindberg box furnace. After exposure the samples were analyzed using SEM. No significant precipitation of new phases, change in the proportion of the original phase composition or change in the respective chemistry was observed in any of the 3 aforestated samples. Thus the cermet composition of example 1, 2 and 3 were determined to possess long term microstructural stability.

Example 6 (Comparative Example)

A comparative example of a system that does not form a preferred thermodynamically stable cermet is prepared using the procedure of Example 1 and 70 vol % of 14.0 μm average diameter of $Cr_3C_2$ powder (99.5% purity, from Alfa Aesar) and 30 vol % of 6.7 μm average diameter 304SS alloy binder powder (Osprey Metals, Fe(balance): 18.5Cr:9.6Ni: 1.4Mn: 0.63Si, 95.9% screened below −16 μm). The disc was then heated to 1400° C. at 15° C./min in argon and held at 1400° C. for 1 hour. During heating, a significant vol % of $Cr_3C_2$ phase is replaced by $Cr_7C_3$ phase. As net result, carbide volume fraction increases and Cr content is depleted in the binder.

The result cermet comprised of the non-equilibrium microstructure:

i) 8 vol % $Cr_3C_2$ with average grain size of 20 μm ii) 72 vol % $Cr_7C_3$ with average grain size of 20 μm iii) 20 vol % Cr-depleted alloy binder Next, the sintered disc was heated in air at 800° C. for 1000 hours. After exposure to 800° C. in air for 1000 hours this cermet comprises:

i) >9.5 vol % $Cr_3C_2$ ii) >85.5 vol % $Cr_7C_3$ iii) <5 vol % Cr-depleted alloy binder (13.2Si:9.4Cr:8.9Fe:68.5Ni in wt %).

Figure 4:
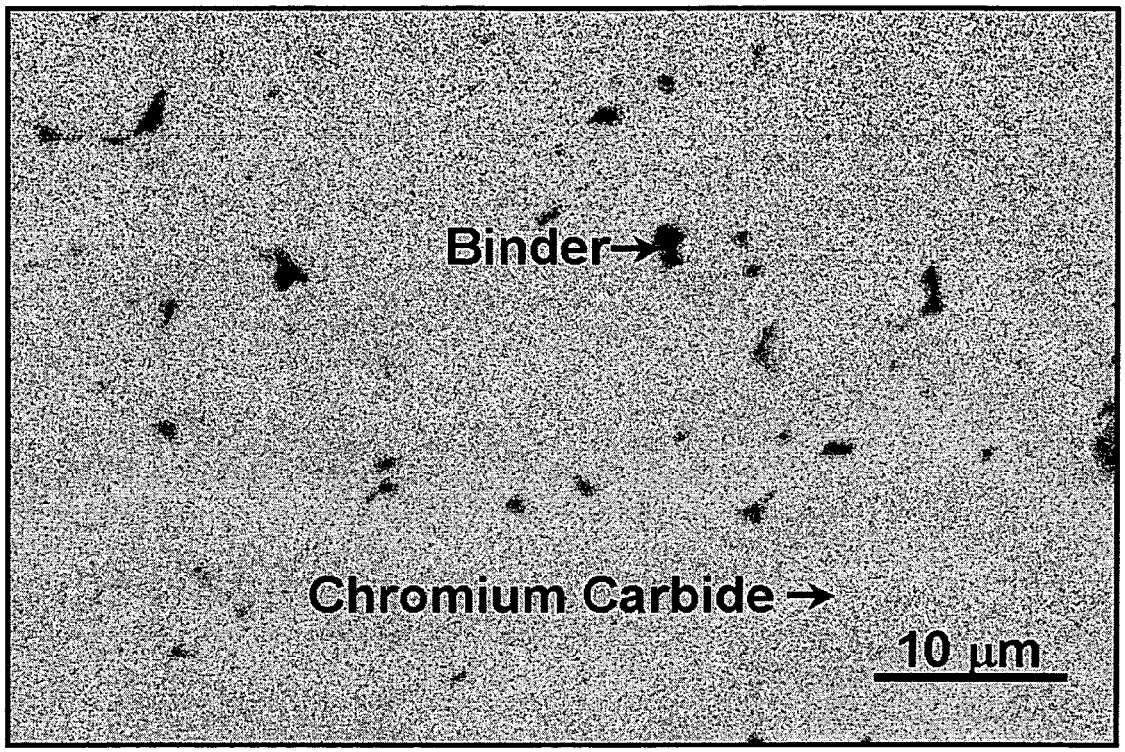
FIG. 4 is a SEM image of the surface of a cermet made with an initial $Cr_3C_2$ in a 30 vol % 304 stainless steel (304SS) binder after exposure to 800° C. for 1000 hours.

FIG. 4 is a SEM image of the cermet after heating in air according to this example, wherein the bar represents 10 μm. In this image the chromium carbide phase appears light and the binder phase appears dark. This figure shows <5 vol % 304SS and >95 vol % chrome carbides after this relative short-term exposure to high temperature. The metal composition has become depleted in chromium content thereby decreasing the fracture toughness of the cermet.

Example 7

Each of the cermets of Examples 1 to 4 was subjected to a hot erosion and attrition test (HEAT) and was found to have an erosion rate of less than $1.0\times10^{-6}$ cc/gram SiC erodant. The procedure employed was as follows:

1) A specimen cermet disk of about 35 mm diameter and about 5 mm thick was weighed.

2) The center of one side of the disk was then subjected to 1200 g/min of SiC particles (220 grit #1 Grade Black Silicon Carbide, UK abrasives, Northbrook, Ill.) entrained in heated air exiting from a tube with a 0.5 inch diameter ending at 1 inch from the target at an angle of 45°. The velocity of the SiC was 45.7 m/sec.

3) Step (2) was conducted for 7 hrs at 732° C.

4) After 7 hrs the specimen was allowed to cool to ambient temperature and weighed to determine the weight loss.

5) The erosion of a specimen of a commercially available castable refractory was determined and used as a Reference Standard. The Reference Standard erosion was given a value of 1 and the results for the cermet specimens are compared in Table 2 to the Reference Standard. In Table 2 any value greater than 1 represents an improvement over the Reference Standard.

TABLE 2

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| Cr3C2 L 30 NiCr {1} | 18.6737 | 15.0660 | 3.6077 | 7.350 | 5.04E+5 | 7.3766E−7 | 1.4 |
| Cr7C3 L 30 NiCr {2} | 23.6681 | 21.0301 | 2.6380 | 7.360 | 5.34E+5 | 6.7121E−7 | 1.6 |
| Cr23C6 L 30 NiCr {3} | 23.5976 | 21.6016 | 1.9960 | 7.350 | 5.04E+5 | 5.3882E−7 | 1.9 |
| Cr3C2 L 15 NiCr {4} | 19.6071 | 17.6609 | 1.9462 | 7.090 | 5.04E+5 | 5.4464E−7 | 1.9 |

Example 8

Each of the cermets of Examples 1 to 4 was subjected to a corrosion test and found to have a corrosion rate less than about $1.0\times10^{-11}$ $g^2/cm^4s$. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hours at 800° C.

4) After 65 hours the specimen was allowed to cool to ambient temperature.

5) Thickness of oxide scale was determined by cross sectional microscopy examination of the corrosion surface.

6) All the thickness of oxide scale formed on specimen surface was less than 1 μm, representing superior corrosion resistance.

What is claimed is:

1. A bulk cermet material comprising:

(a) about 50 vol % to about 95 vol %, based on the total volume of the cermet composition, of a ceramic phase, wherein the ceramic phase being a chromium carbide selected from the group consisting of $Cr_{23}C_6$, $Cr_7C_3$, $Cr_3C_2$ and mixtures thereof; and (b) a binder phase comprising alloys containing about 4 wt % to about 52 wt % Fe; about 36 wt % to about 78 wt % Ni, and about 12 wt % to about 18 wt % Cr; and wherein the overall thickness of the bulk cermet material is greater than 5 millimeters.

2. The bulk cermet material of claim 1 wherein the chromium carbide is $Cr_{23}C_6$.

3. The bulk cermet material of claim 1 wherein the chromium carbide is $Cr_7C_3$.

4. The bulk cermet material of claim 3 wherein the ceramic phase further comprises $Cr_3C_2$.

5. The bulk cermet material of claim 1 wherein the chromium carbide is $Cr_3C_2$.

6. The bulk cermet material as in any one of claims 1 or 2-5 having a long term microstructural stability lasting at least 25 years when exposed at temperatures up to 1000° C.

* * * * *